United States Patent [19]

Hilbert

[11] Patent Number: 4,671,207

[45] Date of Patent: Jun. 9, 1987

[54] MAGNETIC BRUSH DEVELOPMENT APPARATUS

[75] Inventor: Thomas K. Hilbert, Spencerport, N.Y.

[73] Assignee: Eastman Kodak Company, Rochester, N.Y.

[21] Appl. No.: 807,720

[22] Filed: Dec. 11, 1985

[51] Int. Cl.[4] ..... G03G 15/09

[52] U.S. Cl. ..... 118/657; 355/3 DD

[58] Field of Search ..... 118/657, 658; 355/3 DD

[56] References Cited

U.S. PATENT DOCUMENTS

| | | | |
|---|---|---|---|
| 4,022,157 | 5/1977 | Rasekhi et al. | 118/658 |
| 4,086,006 | 4/1978 | Hauser et al. | 355/3 DD |
| 4,194,465 | 3/1980 | Tsukamoto et al. | 118/658 |
| 4,235,193 | 11/1980 | Groen et al. | 118/658 |
| 4,301,228 | 11/1981 | Kori et al. | 430/122 |
| 4,324,483 | 4/1982 | Tagawa et al. | 355/3 DD |
| 4,453,493 | 6/1984 | Sawayama et al. | 118/658 |
| 4,466,728 | 8/1984 | Schlageter | 118/658 |
| 4,546,060 | 10/1985 | Miskinis et al. | 430/108 |

FOREIGN PATENT DOCUMENTS 57-72163 6/1982 Japan .

*Primary Examiner*—Bernard D. Pianalto

*Attorney, Agent, or Firm*—G. Herman Childress

[57] ABSTRACT

Magnetic brush development apparatus for applying developer material to a latent image on a photoconductor includes a housing having a sump which receives a supply of developer material. A magnetic brush spaced from the sump applies the material to the latent image of a photoconductor as the photoconductor is moved past the magnetic brush. Developer material is fed to the brush through an elongate feed slot adjacent to the brush. A feed mechanism delivers developer material from the sump through the slot to the magnetic brush. The feed mechanism includes a rotatable shell and a plurality of magnets that are located within the shell and attract developer material to a portion of the shell. The shell has a deeply fluted outer surface that holds the developer material attracted to the shell as it is delivered from the sump to the slot. The fluted outer surface also assists in removing excess developer material from the area adjacent the slot. The development apparatus is compact and provides improved feeding of developer to the magnetic brush.

6 Claims, 4 Drawing Figures

MAGNETIC BRUSH DEVELOPMENT APPARATUS

BACKGROUND OF THE INVENTION

The present invention relates to magnetic brush development apparatus for applying developer material to a latent image on a photoconductor, and more particularly to improved means for feeding and delivering developer material to the magnetic brush. The magnetic brush apparatus can be used in an electrographic copier/duplicator, for example.

Magnetic brush development apparatus are well known in the art. Such apparatus may include a housing having a sump which receives developer material. When the developer material comprises a mixture of carrier particles and smaller toner particles, the material is mixed in the sump to triboelectrically charge the material prior to delivering it to a developer roller where it can be transferred to an electrostatic image on a photoconductor.

It is desirable to minimize the size of the development apparatus. Such enables a reduction in the overall size of the copier/duplicator or allows addition of other equipment within the same space. Also, color copiers require a plurality of magnetic brush development apparatus at the development station in order to provide toner of different colors to the photoconductor. As many as four development stations may be required in order to provide black toner and three colored toners to a photoconductor. The need for as many as four development apparatus in the development station can require a copier/duplicator to be quite large unless each of the development apparatus in the development station is very compact.

A developer material having permanent magnet carrier particles is disclosed in commonly assigned U.S. Pat. No. 4,546,060 issued Oct. 8, 1985 in the names of E. T. Miskinis and T. A. Jadwin, and entitled "Two-Component, Dry Electrographic Developer Compositions Containing Hard Magnetic Carrier Particles and Method for Using the Same." The magnetic carrier particles in such material have a tendency to cling together to form clumps and, in general, in the absence of an external field, such materials have a tendency to behave somewhat like wet sand due to the magnetic attraction exerted between the particles. Such a material creates special problems in mixing developer material, circulating the material through the development station, agitating and shearing the developer to promote triboelectric charging, and in feeding the developer material to a magnetic brush.

Commonly assigned U.S. patent application Ser. No. 597,323, filed Apr. 6, 1984 in the names of B. J. Joseph and T. K. Hilbert entitled "Electrographic Development Apparatus Having A Ribbon Blender" discloses development apparatus particularly suitable for use with development material having permanent magnetic carrier particles as disclosed in U.S. Pat. No. 4,546,060. More particularly, the apparatus disclosed in application Ser. No. 597,323 includes a ribbon blender that is used for mixing, feeding and triboelectrically charging such material in the sump of a developer station, and a magnetic feed roller that transfers material from the sump to a magnetic brush. A relatively large area is available for transfer of the developer material from the magnetic feed roller to the magnetic brush. Thus a reservoir for developer material is provided near the magnetic brush so that there is a continuous and uninterrupted supply of developer material in that area.

In some instances it is desirable to control the flow of developer material to a magnetic brush, e.g., to turn the flow on or off. This can be accomplished by delivering the material to the brush through a narrow slot that can be closed to shut off the flow of material to the brush. A feed slot effectively eliminates the developer reservoir near the magnetic brush, and requires a continuous and uninterrupted supply of developer material through the slot Also, any excess developer material in the area of the slot should be removed from the area of the slot and returned to the sump to avoid overfeeding of developer material and jamming of the apparatus.

SUMMARY OF THE INVENTION

It is an object of the present invention to provide a relatively small, compact development apparatus for an electrographic copier/duplicator or the like. Another object of the invention is to provide development apparatus suitable for use with development material having permanent magnet carrier particles wherein such material is transferred from a sump through a small metering slot to a magnetic brush. A further object is to provide for continuous flow of development material at a metering slot adjacent a magnetic brush and to remove excess developer material from the area of the slot.

Magnetic brush development apparatus of the present invention is useful for applying developer material to a latent image on a photoconductor. The apparatus includes a housing having a sump for holding a supply of developer material, and a magnetic brush applies developer material to the latent image. Developer material is fed to the brush through an elongate feed slot adjacent the brush. A feed mechanism receives developer material from the sump and delivers such material through the slot to the magnetic brush. The feed mechanism comprises a rotatable shell and a plurality of magnets within the shell for attracting developer material to a portion of the shell. The shell has a deeply fluted outer surface that assists in delivering a continuous supply of developer material to the slot and in removing any excess developer material from the area adjacent the slot. Means are provided for transporting developer material from the sump to a position where it is within the field of the magnets in feed mechanism.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
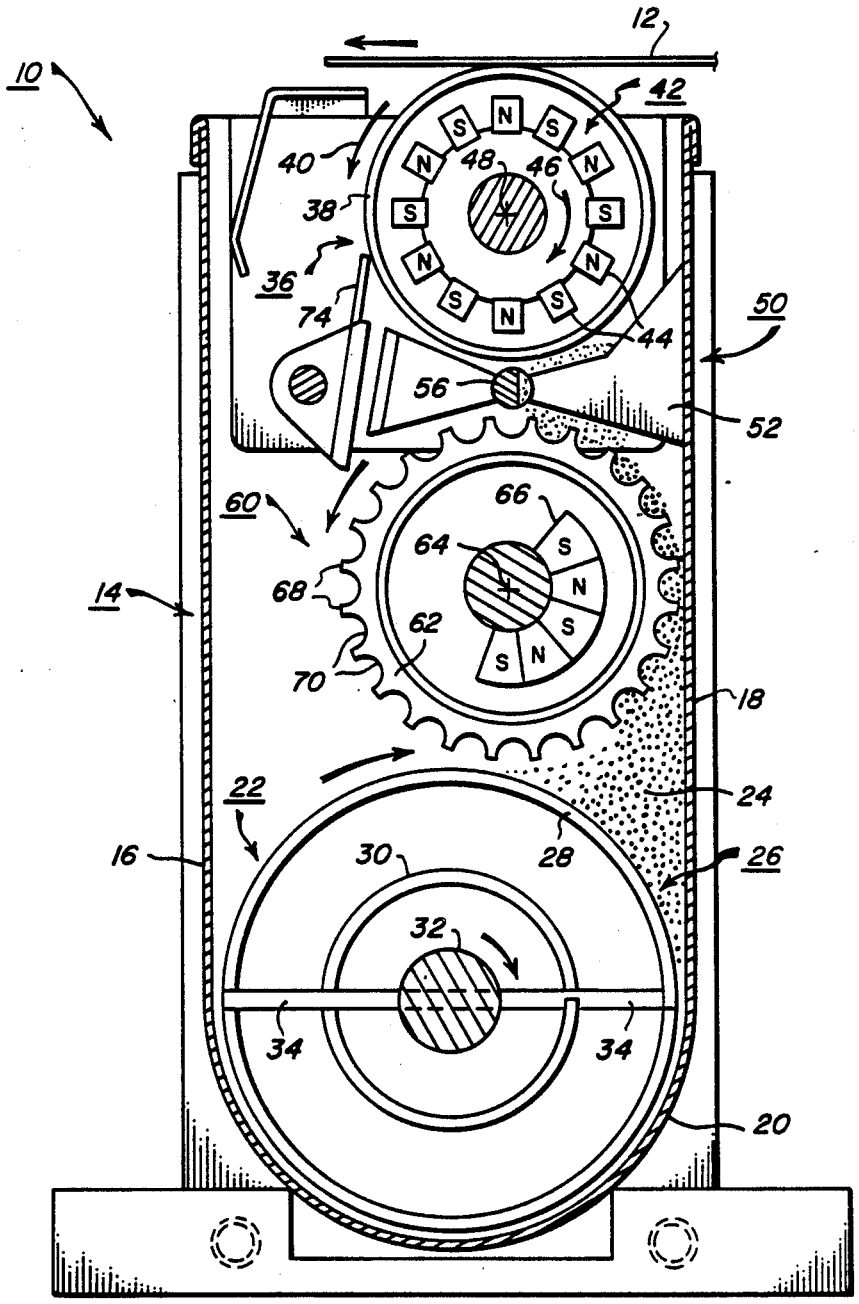
FIG. 1 is an end view of magnetic brush development apparatus of the present invention.

Referring now to FIG. 1 of the drawings, magnetic brush development apparatus of the present invention is generally designated 10 and can be part of an electrographic copier/duplicator, for example. The apparatus is adapted to provide a supply of marking particles, such as toner particles of developer material, to an electrostatic image formed on the lower surface of a photoconductor 12 in order to develop the latent image. The photoconductor can be part of the copier/duplicator and in the form of an endless web or a drum, or it can be discrete sheets on which a copy is formed. As known in the art, the photoconductor 12 is moved past apparatus 10 in the direction shown by the arrow during development of the image on the photoconductor.

Apparatus 10 comprises a vertically elongated housing 14 having spaced and generally parallel vertical sidewalls 16 and 18 and a generally semi-cylindrical bottom 20 that joins the sidewalls. The lower portion of the housing defines a sump 22 for holding a supply of developer material 24. Developer material 24 can be of any known type, including single-component or two-component developer materials, including the two-component developer materials having hard, permanent magnetic carrier particles as disclosed in the before-mentioned U.S. Pat. No. 4,546,060.

It is known to mix developer material 24 in sump 22 in order to provide triboelectric charging of the developer material, move the material along the length of the sump, etc. Developer material having permanent magnet carrier particles presents special problems in mixing of the material because the developer material tends to clump together. Thus, the sump preferably has a ribbon blender generally designated 26 for mixing the developer material in the sump. A ribbon blender for this purpose is disclosed in the before-mentioned copending U.S. patent application Ser. No. 597,323.

The ribbon blender 26 comprises an outer helical ribbon 28 and an inner helical ribbon 30. Both ribbons are coiled concentrically about a shaft 32. Shaft 32 is concentrically located with respect to the semi-cylindrical bottom 20 of the housing. A plurality of rods 34 project from shaft 32, and the ribbons 28, 30 are attached to the rods so that the ribbons rotate with the shaft 32. Ribbon 28 preferably has the same pitch throughout its length, as does ribbon 30. However, ribbon 28 has a pitch that is opposite from the pitch of ribbon 30. The ribbons are constructed so that when the shaft 32 is rotated the outer ribbon 28 tends to drive developer material in sump 22 in a direction inwardly from the front of the housing and ribbon 30 tends to drive developer material from the rear of the housing toward the front thereof. The two ribbons provide plenty of axial mixing, shearing, etc. of the developer material in order to prevent formation of lumps of developer material even when the carrier particles of the material comprises permanent magnets.

At the top of housing 14 is a magnetic brush generally designated 36. The brush may be of any suitable construction. The brush illustrated in the drawings comprises a shell 38 of a non-magnetic material that rotates counterclockwise as indicated by arrow 40 about a core 42. Core 42 comprises a plurality of permanent magnets 44 rotatable in a clockwise direction as shown by arrow 46. The axis of rotation of the core and shell is designated 48. A portion of the magnetic brush 36 projects through the top of the housing 14 and lies directly underneath the photoconductor 12.

Figure 2:
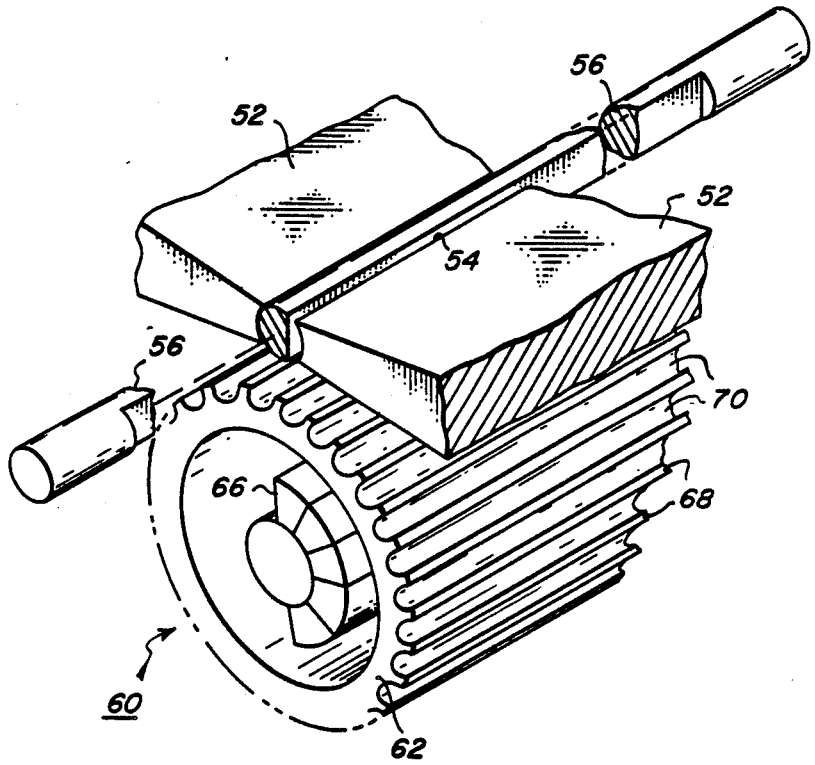
FIG. 2 is a fragmentary perspective of the feed mechanism and metering assembly shown in FIG. 1.
Figure 3:
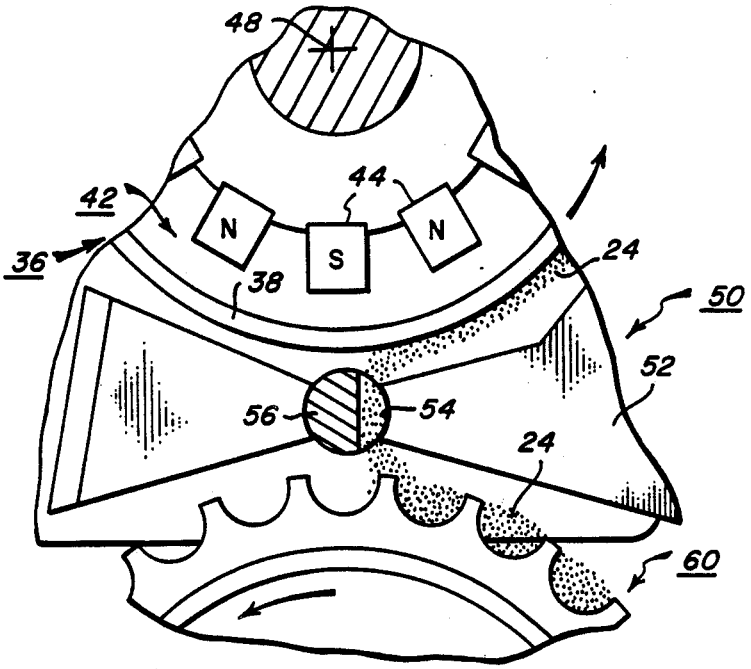
FIG. 3 is an enlarged fragmentary view showing portions of the metering assembly, magnetic brush and feed mechanism with a slot in the metering assembly open to the flow of developer material.
Figure 4:
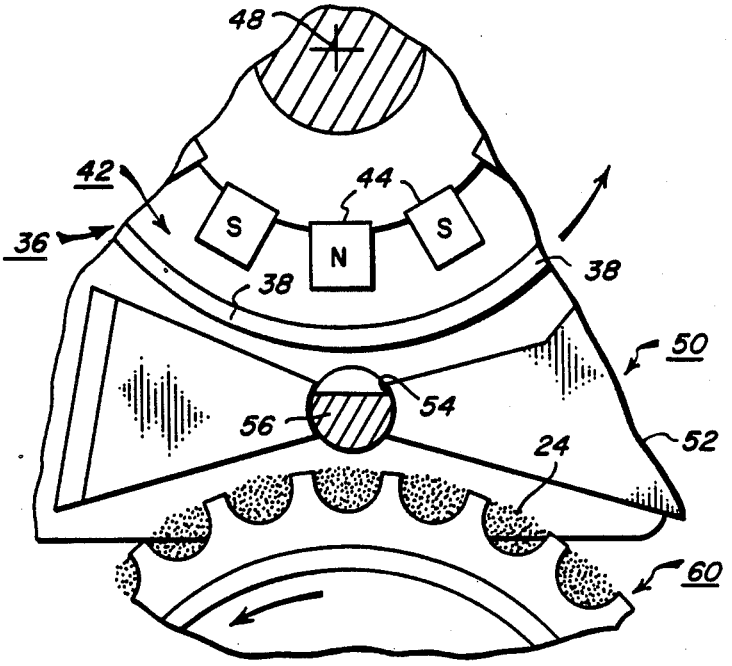
FIG. 4 is a view similar to FIG. 3 but showing the metering assembly slot closed.

Immediately beneath the magnetic brush 36 is a metering assembly generally designated 50. Referring to FIGS. 2–4, the metering assembly comprises an elongate block 52 that is beneath the lower quadrant of the magnetic brush 36 and substantially isolates it from the lower portion of the housing 14. Block 52 can be connected to and supported from the housing 14. In the center portion of block 52, near the lower portion of the magnetic brush, there is an elongate, generally cylindrical feed slot 54 that extends substantially the full length of the brush 36 and lies adjacent to the outer surface of the shell 38 of the magnetic brush. As shown in FIG. 3, developer material 24 received from the lower portion of the housing can pass through slot 54 to the brush 36, such material being attracted to the outer surface of shell 38 by the magnets 44 in the core of the magnetic brush.

In order to control the flow of developer material through slot 54, the apparatus preferably is provided with a control rod 56 having a D-shaped portion located within slot 54. The rod has cylindrical ends 57 that project from the ends of the slot and are mounted for rotation about an axis passing through the rod. The portion of the rod in the slot is substantially semi-cylindrical in shape and the rod is mounted so that it can be rotated about its axis between the positions shown in FIGS. 3 and 4. When the rod is in the FIG. 3 position material 24 can flow past the rod through slot 54 to the magnetic brush 36. When the rod is in the position shown in FIG. 4, slot 54 is substantially closed to the passage of developer material to the magnetic brush. Thus by manipulating the rod the flow of developer material to the magnetic brush can be quickly started and stopped, with a rapid response at the development zone between the magnetic brush and the photoconductor.

A feed mechanism generally designated 60 is located between metering assembly 50 and the ribbon blender 26. Feed mechanism 60 receives developer material driven from the sump 22 by the ribbon blender and delivers such material to the metering assembly and through the slot 54 to the magnetic brush. Feed mechanism 60 comprises a shell 62 rotatable in a counterclockwise direction about an axis 64. Within the shell there are a plurality of stationary magnets 66 that extend about 160 degrees counterclockwise from a position generally directly above the ribbon blender 26 to a position just ahead of the feed slot 54. Developer material from the sump is attracted to the shell 62 and held to the shell in the area under the influence of the magnets 66. Thus the material can be transported from the sump to the slot 54 without dropping from the shell.

Preferably the shell has a deeply fluted outer surface comprising a plurality of gear-like teeth 68 separated by deep arcuate grooves 70. Both the teeth 68 and grooves 70 extend the full length of the shell 62. The shell can be about 0.5 cm. in diameter and the depth of the grooves 70 can be approximately 0.024 cm., for example. A shell with these dimensions can have about 24 grooves in the surface. The deeply fluted outer surface of the shell greatly assists in delivering a substantial and continuous supply of developer material to the slot 54 and in removing any excess developer material from the area adjacent the slot during operation of the apparatus.

As noted before, developer material provided to the magnetic brush 36 is used for developing a latent image on the lower surface of the photoconductor 12 in a development zone between the brush and the photoconductor. After development of the latent image, continued rotation of the shell 38 of the magnetic brush brings the developer material remaining on the brush to a wiper 74 that scrapes the material from the shell. The removed material returns by gravity to the sump 22 where it is mixed with the ribbon blender with developer material remaining in the sump. The material returned from the brush will be partially depleted of toner. Accordingly, fresh toner is periodically provided to the sump 22. The toner replenishment mechanism (not shown) can be located along the left side of the housing, above the ribbon blender 26 and to the left of the feed mechanism 60, or at one end of the ribbon blender.

During operation, the ribbon blender and the core 42 of the magnetic brush are driven in a clockwise direction while the feed mechanism 60 and the shell 38 of the magnetic brush are driven in a counterclockwise direction. Operation of the ribbon blender 26 agitates, shears and moves the developer material 24 axially back and forth in the sump 22 with ribbon 28 being effective to drive the material from front to rear as viewed in the drawings and the ribbon 30 being effective to drive the material in the opposite direction. Thus the development material is thoroughly mixed, sheared, and triboelectrically charged. In addition, toner-depleted developer material returned to the sump from the magnetic brush is mixed with material remaining in the sump and with fresh toner from a toner replenisher (not shown) in order to maintain the desired concentration of toner in the apparatus. Rotation of the ribbon 28, and the fact that it is larger than the ribbon 30, causes developer material to accumulate along the right sidewall 18 of housing 14 in the area between the ribbon blender and the lower-right quadrant of the feed mechanism 60 opposite the magnets 66. Developer material along the lower-right quadrant of the feed mechanism 60 is urged toward the feed mechanism by the stationary magnets 66 located within the shell 62 and is received in the elongate grooves 70 in the outer surface of the shell. As the shell rotates a relatively large quantity of developer material is transported counterclockwise around the feed mechanism and de1ivered idto the area of the slot 54 in the metering assembly 50. When the D-shaped portion of rod 56 is in the position shown in FIG. 3, slot 54 is opened and developer material can pass through slot 54 and be delivered to the magnetic brush 36. The material is attracted to the shell 38 of the magnetic brush by the magnets 44 of the core 42. The developer material is transported by the magnetic brush into contact with the latent image on the lower surface of the photoconductor 12 so that toner particles in the developer material can be transferred to the latent image. The latent image is then either fixed on the photoconductor 12 or transferred to a copy sheet and fixed onto that sheet in a manner known in the electrographic arts. The developer material remaining on the magnetic brush is scraped from the shell 38 by the wiper 74 and returned to the sump.

Feed mechanism 60 provides a thin but continuous layer of developer material to slot 54 for delivery through the slot to the magnetic brush. The feed mechanism delivers more developer material to the slot 54 than can pass through the slot. It is desirable to remove excessive developer material from the area adjacent the slot to avoid jamming, etc. This is accomplished by the grooves 70 in the shell 62 which transport excess developer material from the area of the slot in a counterclockwise direction away from the slot. Any such excess is removed from the grooves and is returned to the sump by gravity. Thus the deeply fluted surface of feed mechanism 60 is effective not only to move developer material to the magnetic brush but also assists in the removal of any excess material from the area of slot 54. This provides a balanced, continuous flow of developer material and decreases the possibility of overfeeding of development material at high revolutions per minute and subsequent jamming of the apparatus. At the same time, the deeply fluted shell provides a continuous and uninterrupted supply of developer material to the slot 54 so that the brush is not starved for developer material even at relatively high copying rates.

Housing 14 is thin, and the ribbon blender, feed mechanism, metering assembly and magnetic brush are vertically aligned within the housing. As a result, the apparatus 10 is very compact. Due to its compactness, the apparatus can replace prior development apparatus requiring almost three times as much space while maintaining the effectiveness of the apparatus in developing latent images on the photoconductor. By way of example, apparatus of the invention can be about 2.4 cm. high and about 0.8 cm. wide, such being about one-third the width of apparatus it can replace. The compactness of apparatus 10 permits a reduction in size of the associated copier/duplicator or permits a plurality of development apparatus to be installed in the same space previously occupied by one such apparatus. Also, the apparatus can handle development material having carrier particles comprises permanent magnets, as disclosed in U.S. Pat. No. 4,546,060, mentioned before.

The invention has been described in detail with particular reference to a preferred embodiment thereof, but it will be understood that variations and modifications can be effected within the spirit and scope of the invention as described hereinabove and as defined in the appended claims.

I claim:

1. Magnetic brush development apparatus for applying developer material to a latent image on a photoconductor, the apparatus comprising:

a housing having in a lower portion thereof a sump for holding a supply of developer material;

a magnetic brush in an upper portion of the housing for applying developer material to the latent image;

a metering assembly adjacent the magnetic brush and substantially isolating the brush from the lower portion of the housing, the metering assembly having an elongate feed slot adjacent the brush through which developer material from the sump can be fed to the brush, and the metering assembly further comprising means for opening and closing the slot to the flow of developer material through the slot;

a feed mechanism spaced from the sump and adjacent the slot in the metering assembly, the feed mechanism being effective to receive developer material from the sump and to deliver such material through the slot to the magnetic brush, the mechanism comprising a rotatable generally cylindrical shell and a plurality of magnets within the shell for attracting developer material to a portion of the shell, the shell having a deeply fluted outer surface that assists in delivering a continuous supply of developer material to the slot and in removing any excess developer material from the area adjacent the slot; and means in the sump for transporting developer material to a position where it is within the field of the magnets in the feed mechanism.

2. Apparatus as set forth in claim 1 wherein the fluted surface of the shell comprises a plurality of deep grooves of semi-cylindrical shape extending longitudinally along the shell and in closely-spaced relationship so that a substantial quantity of developer material can be transported by the shell.

3. Apparatus as set forth in claim 1 wherein the magnets of the feed mechanism are located adjacent the portion of the shell that is being advanced toward the feed slot, and the portion of the shell that is being advanced away from the feed slot is spaced from the magnets so that developer material can be removed by gravity from the shell.

4. Apparatus as set forth in claim 1 wherein the transporting means comprises a ribbon blender that mixes developer material in the sump and delivers such material to the feed mechanism.

5. Apparatus as set forth in claim 4 wherein the housing is narrow and vertically elongated in shape, and the magnetic brush, feed mechanism and ribbon blender are substantially vertically aligned in the housing, thereby providing a compact apparatus.

6. Magnetic brush development apparatus for applying developer material to a latent image on a photoconductor, the apparatus comprising;

a housing having in a lower portion thereof a sump for holding a supply of developer material;

a magnetic brush in an upper portion of the housing for applying developer material to the latent image;

means between the upper and lower portions of the housing defining an elongate feed slot through which developer material can be fed from the sump to the brush;

means for opening and closing the feed slot to the flow of developer material;

a feed mechanism for receiving developer material from the sump and for delivering such material through the slot to the magnetic brush, the mechanism comprising a rotatable generally cylindrical shell and a plurality of magnets within the shell for attracting developer material to a portion of the shell, the shell having a deeply fluted outer surface that assists in delivering a continuous supply of developer material to the slot and in removing any excess developer material from the area adjacent the slot; and a ribbon blender in the sump for mixing developer material in the sump and delivering such material to a position where it is within the field of the magnets in the feed mechanism, the housing being narrow and vertically elongated in shape, and the magnetic brush, feed mechanism and ribbon blender being substantially vertically aligned in the housing, thereby providing a compact development apparatus.

* * * * *